US007012626B2

(12) United States Patent
Shingai et al.

(10) Patent No.: US 7,012,626 B2
(45) Date of Patent: Mar. 14, 2006

(54) DRIVING METHOD OF DISPLAY DEVICE

(75) Inventors: Akira Shingai, Chiba (JP); Naoki Tokuda, Mobara (JP)

(73) Assignee: Hitachi Displays, Ltd., Chiba (JP)

( * ) Notice: Subject to any disclaimer, the term of this patent is extended or adjusted under 35 U.S.C. 154(b) by 0 days.

(21) Appl. No.: 10/872,430

(22) Filed: Jun. 22, 2004

(65) Prior Publication Data

US 2004/0263442 A1 Dec. 30, 2004

(30) Foreign Application Priority Data

Jun. 24, 2003 (JP) ..... 2003-178956

(51) Int. Cl.
*G09G 5/10* (2006.01)
*G09G 3/30* (2006.01)
*G09G 3/10* (2006.01)

(52) U.S. Cl. ..... 345/690; 345/76; 345/77; 315/169.3

(58) Field of Classification Search ..... 315/169.2, 315/169.3; 345/690, 214, 55, 76–77, 84, 345/212; G09G 3/10, 5/10, 3/30
See application file for complete search history.

(56) References Cited

U.S. PATENT DOCUMENTS 6,806,497 B1 * 10/2004 Jo ..... 257/59
2003/0214467 A1 * 11/2003 Koyama et al. ..... 345/82
2004/0130545 A1 * 7/2004 Ishizuka ..... 345/212

* cited by examiner

*Primary Examiner*—Thuy Vinh Tran
(74) *Attorney, Agent, or Firm*—Reed Smith LLP; Stanley P. Fischer, Esq.; Juan Carlos A. Marquez, Esq.

(57) ABSTRACT

The present invention provides a driving method for a display device which includes a display part having pixels of M columns×N rows and a memory, wherein each pixel includes a light emitting element and a driving transistor for driving the light emitting element. At times other than a usual light emitting time, a driving voltage is applied to the driving transistor of each pixel so as to turn on the light emitting element of each pixel, a value of current which flows in the light emitting element of each pixel is detected, correction data for each pixel is calculated based on the detected value of current, and the calculated correction data for each pixel is stored in the memory. At the usual light emitting time, a driving voltage which is based on data which is obtained by adding the correction data stored in the memory to video signal data is applied to the driving transistor of each pixel.

4 Claims, 10 Drawing Sheets

DRIVING METHOD OF DISPLAY DEVICE

The present application claims priority from Japanese application JP2003-178956 filed on Jun. 24, 2003, the content of which is hereby incorporated by reference into this application.

BACKGROUND OF THE INVENTION

1. Field of the Invention

The present invention relates to a method for driving a display device, and more particularly to a technique which is effectively applicable to an analogue-drive active matrix type organic EL (Electro Luminescence) display device.

2. Description of the Related Art

Recently, an electro luminescence display device (referred to as an EL display device hereinafter) which uses organic electro luminescence elements has been attracting attentions as a next-generation flat display device which replaces a CRT and a liquid crystal display device.

The EL display device has, compared to a currently available flat display device such as a liquid crystal display device, advantageous features including (1) a voltage necessary for emission of light is 10V or less and hence, the power consumption can be reduced, (2) the EL display device is of a self-luminous type and hence, a backlight is unnecessary, (3) the vacuum structure required by a plasma display device which is also of a self-luminous type is no more necessary and hence, the EL display device can be easily made light weighted and thin, and (4) the response time is short, that is, several $\mu$ seconds and a viewing angle is wide, that is, 170 degrees or more.

As a representative driving method of such an EL display device, an analogue type driving method (see following patent literature 1) or a PWM (Pulse Width Modulation) type driving method (see following patent literature 2) are known.

Here, as the prior art literatures relevant to the present invention, followings are named.

[Patent literature 1]

JP-A-8-241048

[Patent literature 2]

JP-A-2002-108285

SUMMARY OF THE INVENTION

In the analogue type driving method which is disclosed in the above-mentioned patent literature 1, a video signal voltage is written in a storage capacitor connected between a gate and a source of a driving TFT via a data writing TFT (Thin-Film-Transistor) and a current which flows in the driving TFT is controlled in response to the voltage held in the storage capacitor thus making an organic EL element emit light.

In general, the TFT exhibits the large irregularities among individual elements compared to single-crystal Si elements and hence, particularly, when a large number of TFTs are incorporated or built in as in the case of the pixel, it is extremely difficult to suppress the irregularities in characteristics among the respective elements. For example, it has been known that when the TFTs are formed of low-temperature polycrystalline Si, the irregularities in the order of 1V is generated with respect to a threshold value voltages (Vth).

Then, the irregularities in the threshold voltages (Vth) of the driving TFTs directly lead to the irregularities of a driving current of the organic EL element and the driving current of the organic EL element is proportional to the brightness of the organic EL element.

Accordingly, there has been a drawback that the uniformity of brightness is lowered in the analogue-type driving method.

Further, in a PWM type driving method disclosed in the above-mentioned patent literature 2, a driving TFT is driven in a saturated state and the brightness of an organic EL element is controlled based on a length of a light emitting period.

According to the PWM type driving method, since the driving TFT is used only for turning on and off the organic EL element, the influence of the irregularities of a threshold voltage (Vth) which the driving TFT receives is eliminated.

However, in the PWM type driving method, the degradation of image quality attributed to "pseudo profile" noises is generated. This is a phenomenon which arises as a problem in a plasma display, wherein when a display period is time-sequentially biased within a frame, profile-like noises arise in the animated image.

The present invention has been made to solve the above-mentioned drawbacks of the prior art and it is an object of the present invention to prevent the lowering of the uniformity of brightness generated due to the irregularities in threshold values of driving transistors in a display device adopting an analogue driving method.

The above-mentioned and other objects and novel features of the present invention are clearly understood by the description of this specification and attached drawings.

To briefly explain the summary of representative invention among the inventions disclosed in the present application, they are as follows.

To overcome the above-mentioned task, in a display device which includes a display part having pixels of M columns×N rows and a memory, wherein each pixel includes a light emitting element and a driving transistor for driving the light emitting element, at times other than a usual light emitting time, a driving voltage is applied to the driving transistor of each pixel so as to turn on the light emitting element of each pixel and a value of current which flows in the light emitting element of each pixel is detected, correction data for each pixel are calculated based on the detected value of current, the calculated correction data of each pixel are stored in the memory, and at the usual light emitting time, a driving voltage based on data which is obtained by adding the correction data stored in the memory to video signal data is applied to the driving transistor of each pixel, thus preventing the lowering of the uniformity of the brightness.

Further, according to the present invention, the step in which a driving voltage is applied to driving transistors of respective pixels in a pixel block formed of pixels of i (i<M) columns×j(j<N) rows so as to turn on only the light emitting elements of respective pixels in the inside of the pixel block and values of currents which flow in the respective light emitting elements in the inside of the pixel block are detected is executed by shifting the pixel block in the row direction and the column direction one pixel by one pixel, and the values of currents of one pixel are detected by obtaining the difference among the values of currents which flow in the respective light emitting elements in the inside of the detected pixel block.

DETAILED DESCRIPTION

Hereinafter, a mode for carrying out the present invention is explained in detail in conjunction with drawings showing embodiments.

Here, in all drawings for explaining the mode for carrying out the invention, parts having identical functions are given the same symbols and their repeated explanation is omitted.

Figure 1:
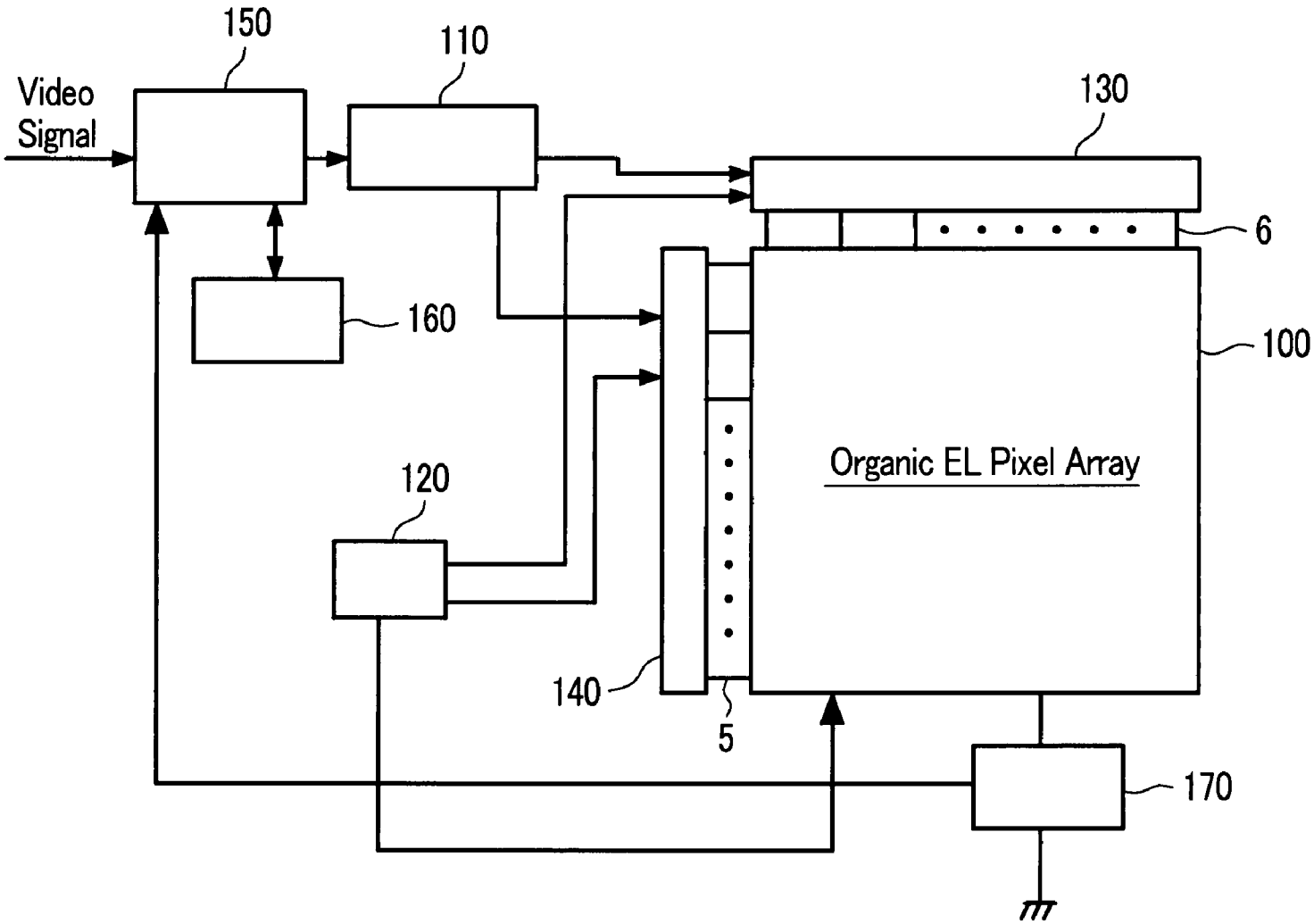
FIG. 1 is a block diagram showing the schematic constitution of an EL display device of an embodiment of the present invention.

FIG. 1 is a block diagram showing the schematic constitution of an EL display device of an embodiment of the present invention. The EL display device of this embodiment is an active matrix type EL display device adopting an analog type driving method.

In FIG. 1, a data driver 130 and a scanning driving circuit 140 display an image on a display part 100 based on control signals transmitted from a timing control circuit 110. Here, various power source voltages are supplied to the display part 100, the data driver 130 and the scanning driving circuit 140 from a power source circuit 120. Here, the sequence which displays the image on the display part 100 is equal to the sequence of a conventional EL display device and hence, the detailed explanation of the sequence is omitted.

The display part 100 is constituted of an organic EL pixel array in which pixels having organic EL elements are arranged in an array of M columns×N rows.

Figure 2:
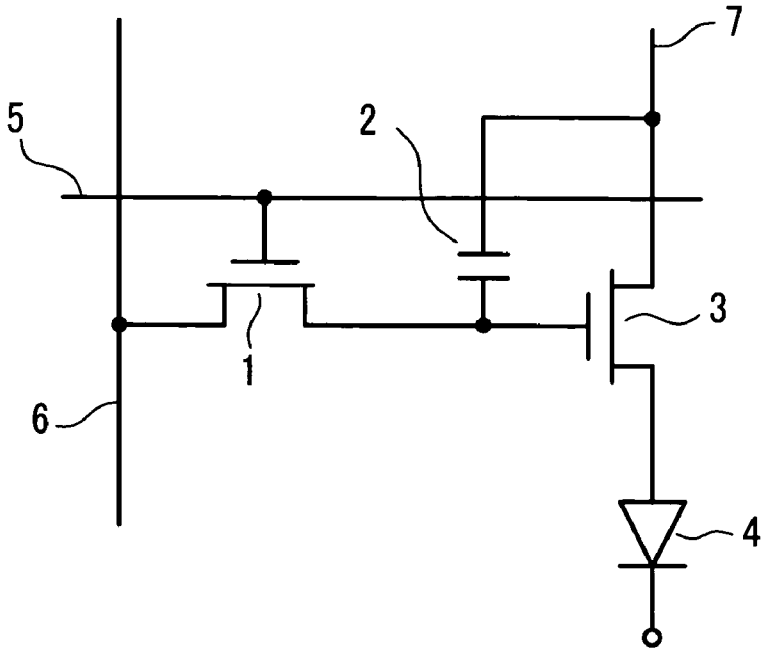
FIG. 2 is an equivalent circuit diagram showing one example of the constitution of one pixel of a display part shown in FIG. 1.

FIG. 2 is an equivalent circuit diagram showing one example of the constitution of one pixel of the display part 100 shown in FIG. 1.

As shown in FIG. 2, each pixel includes an organic EL (Organic Electro-luminescent) element 4, a driving thin film transistor (a driving TFT, hereinafter) TFT 3 for driving the organic EL element 4, a data holding capacitive element 2, and a data writing thin film transistor (a data writing TFT, hereinafter) 1.

The data writing TFT 1 has a gate thereof connected to a scanning line 5 and a source thereof connected to a data line 6. The scanning line 5 is connected to the scanning driving circuit 140 and the data line 6 is connected to the data driver 130. The data holding capacitive element 2 is connected between a gate of the driving TFT 3 and a power source line 7.

When a voltage which turns on the data writing TFT 1 is applied from the scanning line 5, the data writing TFT 1 is turned on. At this point of time, by supplying a video signal voltage from the data line 6, the driving TFT 3 is turned on so that the organic EL element 4 is turned on and, at the same time, the video signal voltage is stored in the data holding capacitive element 2.

Due to such a constitution, even when the voltage which turns on the data writing TFT 1 is no more applied to the scanning line 5, the driving TFT 3 is turned on so that the organic EL element 4 is held in the turn-on state.

In this embodiment, there is provided a current detection circuit 170. Using this current detection circuit 170, at times other than usual light emitting time, the driving voltage is applied to the driving TFT 3 of each pixel so as to turn on the organic EL element 4 of each pixel and a value of current which flows in the organic EL element 4 of each pixel is detected.

Based on the detected current value, in a frame memory control circuit 150, correction data for every pixel is calculated and the calculated correction data for every pixel is stored in a frame memory 160.

Then, at the usual light emitting time, data obtained by adding the correction data stored in the frame memory 160 to video signal data inputted from the outside are transmitted to the data driver 130.

The data driver 130 includes a D-A converting circuit. Using this D-A converting circuit, a driving voltage is generated based on the data obtained by adding the correction data to the video signal data inputted from the outside and, the driving voltage is applied to the driving TFT 3 of each pixel.

In this manner, according to this embodiment, it is possible to prevent the lowering of uniformity of brightness which has been a drawback of the conventional active matrix type EL display device adopting the analog driving method.

Hereinafter, the principle of the detection method of the value of current which flows in the organic EL element 4 of each pixel in this embodiment is explained.

Figure 3:
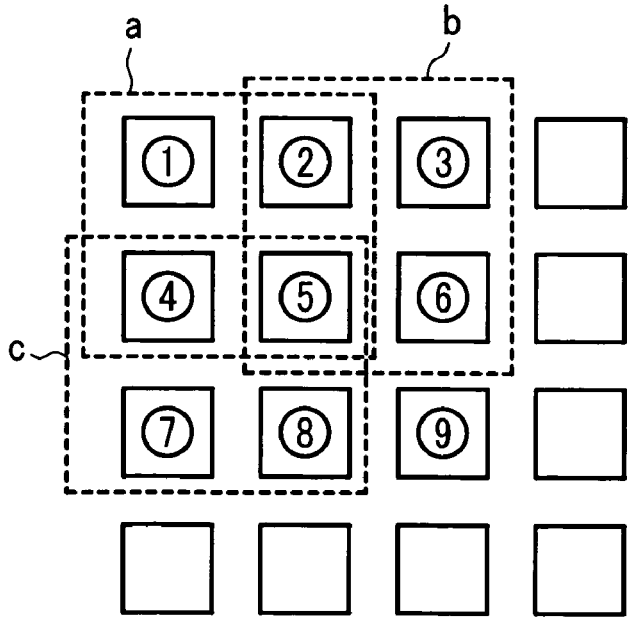
FIG. 3 is a view for explaining the principle of a method for detecting current values which flow in organic EL elements of respective pixels in the embodiment of the present invention.

For example, as shown in FIG. 3, assume that there are provided pixels ① to ⑨ and irregularities are present with respect to a threshold voltage (Vth) of the driving TFT 3 of the pixel ①. Further, as a pixel block, a pixel block constituted of pixels in an array of 2 columns×2 rows is assumed.

Then, the pixel block is scanned by shifting the pixel block by one pixel as indicated by dotted frames a, b, c shown in FIG. 3 so as to turn on the organic EL elements 4 of the respective pixels within the pixel block, and the value of current which flows in the organic EL elements 4 of each pixel is detected by the current detection circuit 170.

Here, the value of current which is detected when the pixel block assumes the dotted line frame a shown in FIG. 3 becomes (3lo+lv). Here, lo is the value of current which flows in the organic EL elements 4 of the pixel ②, the pixel ④ and the pixel ⑤ and lv is the value of current which flows in the organic EL element 4 of the pixel ①.

Further, the value of current which is detected when the pixel block assumes the dotted line frame b and the dotted line frame c in FIG. 3 becomes 4lo.

Accordingly, the value of current which is detected when the pixel block assumes the dotted line frame a shown in FIG. 3 and the value of current which is detected when the pixel block assumes the dotted line frame b and the dotted line frame c shown in FIG. 3 differ from each other, while the value of currents which is detected when the pixel block assumes the dotted line frame b and the value of current which is detected when the pixel block assumes the dotted line frame c are equal and hence, it is determined that the value of current which flows in the organic EL element 4 of the pixel ① differs from the value of current which flows in the organic EL element 4 of other pixels.

Further, since the difference between the value of current which is detected when the pixel block assumes the dotted line frame a shown in FIG. 3 and the value of current which is detected when the pixel block assumes the dotted line frame b shown in FIG. 3 becomes (lo−lv) and hence, the value of current lv can be detected when the value of current lo is known.

Here, since the value of current lo is known due to the specification at the time of designing. As a result, the value of current lv which flows in the organic EL element 4 of the pixel ① can be detected. Further, based on the value of currents lo and lv, the correction data can be calculated.

Hereinafter, the method of detecting the value of currents which flow in the organic EL elements 4 of the respective pixels in this embodiment is explained. The currents flowing through the organic EL elements 4 are evaluated by following four sequences.

<First Sequence>

Figure 4A:
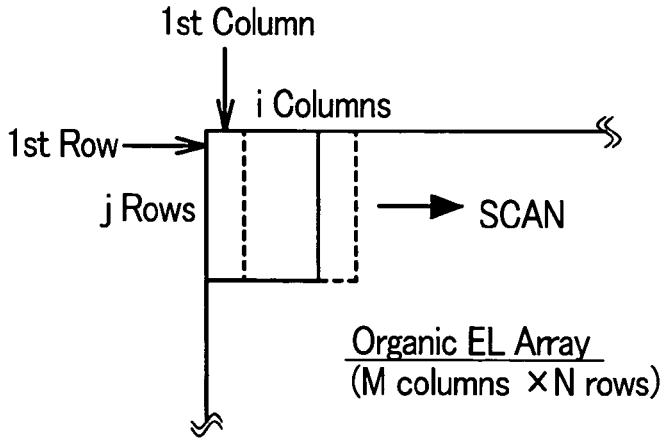
FIG. 4 is a view for explaining the method for detecting current values which flow in organic EL elements of respective pixels in the embodiment of the present invention.

As shown in FIG. 4A, the driving voltage is applied to the driving TFT 3 of the respective pixels in the pixel block which is constituted of i (i<M) columns×j (j<N) rows including pixels of the first row and the first column in the display part 100 having the pixels of M columns×N rows so as to turn on the organic EL elements 4 in the pixel block and the value of currents are detected by the current detection circuit 170.

Next, the pixel block is scanned by shifting the pixel block along an extension direction of the column one pixel by one pixel from the first row to the (N−j) row so as to turn on the organic EL elements 4 in the pixel block, and the value of currents are detected by the current detection circuit 170. This scanning sequence is exemplified as respective locations of solid-lined frames (each means a starting area for a scanning along an extension direction of the row, explained next) shifting from that in FIG. 4A to that in FIG. 4C.

Figure 4B:
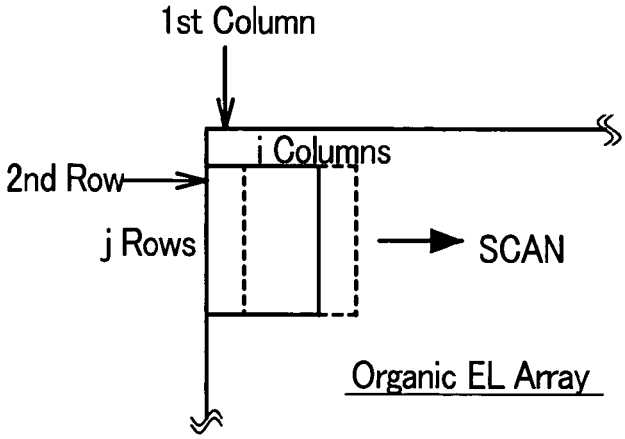
Figure 4C:
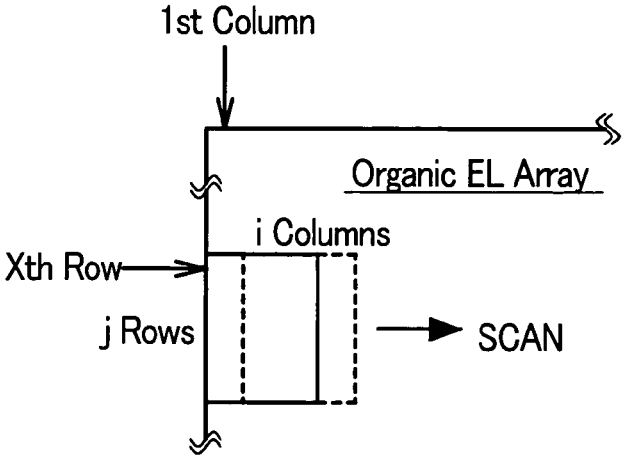

With respect to each stage during the scanning in the column direction, the pixel block is scanned by shifting the pixel block in the scanning direction (an arrow denoted by "SCAN") shown in FIG. 4 one pixel by one pixel from the first column to the (M−i) column so as to turn on the organic EL elements 4 in the pixel block and the value of currents are detected by the current detection circuit 170. This scanning is started from each of the starting areas exemplified in FIGS. 4A–4C, and is held (N−j) times in this example. Accordingly, the values of current which flow in the organic EL elements 4 of the respective pixels are detected.

<Second Sequence>

Figure 5A:
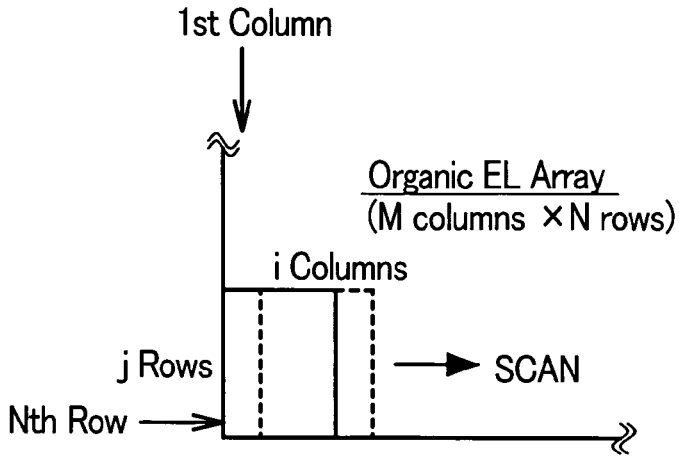
FIG. 5 is a view for explaining the method for detecting current values which flow in organic EL elements of respective pixels in the embodiment of the present invention.

Further, as shown in FIG. 5A, the driving voltage is applied to the driving TFT 3 of the respective pixels in the pixel block which is constituted of the pixels of i columns×j rows including pixels of the Nth row and the first column in the display part 100 so as to turn on the organic EL elements 4 in the pixel block and the value of currents are detected by the current detection circuit 170.

Figure 5B:
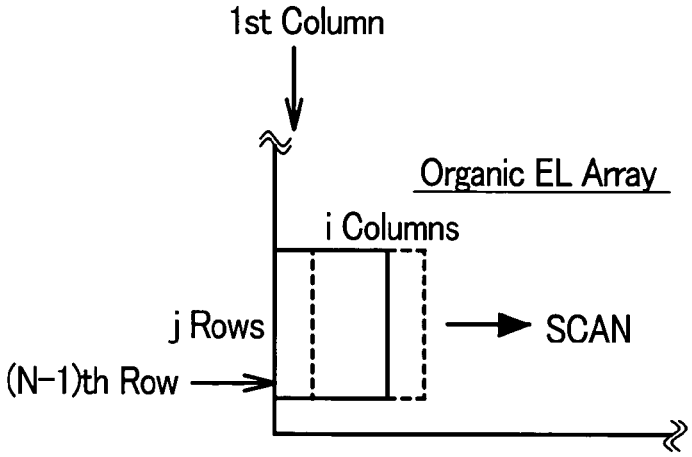
Figure 5C:
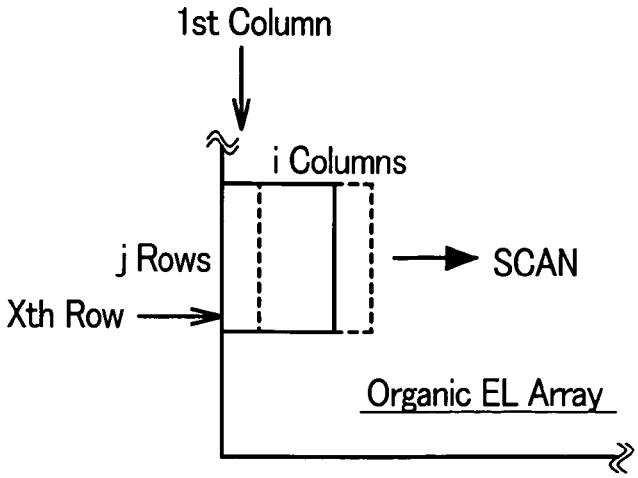

Next, the pixel block is scanned by shifting the pixel block along the extension direction of the column one pixel by one pixel from the Nth row to the first row so as to turn on the organic EL elements 4 in the pixel block and the value of currents are detected by the current detection circuit 170. This scanning sequence is exemplified as respective locations of solid-lined frames shifting from that in FIG. 5A to that in FIG. 5C (in the counter direction to that explained by FIGS. 4A–4C).

With respect to each stage during the scanning in the column direction, the pixel block is scanned by shifting the pixel block one pixel by one pixel from the first column to the M−i column so as to turn on the organic EL elements 4 in the pixel block and the value of currents are detected by the current detection circuit 170. This scanning is started from each of the starting areas exemplified by the solid-lined frame shown in FIGS. 5A–5C. Accordingly, the values of currents of the regions which cannot be detected during the first sequence explained in FIGS. 4A–4C are detected.

<Third Sequence>

Figure 6A:
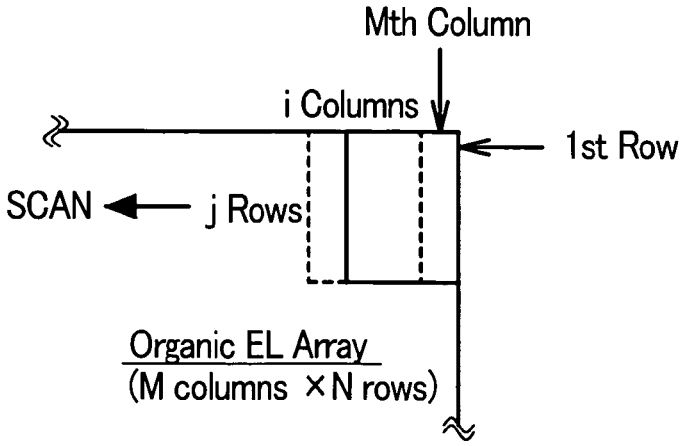
FIG. 6 is a view for explaining the method for detecting current values which flow in organic EL elements of respective pixels in the embodiment of the present invention.

Further, as shown in FIG. 6A, the driving voltage is applied to the driving TFT 3 of the respective pixels in the pixel block which is constituted of the pixels of i columns×j rows including pixels of the first row and the Mth column in the display part 100 so as to turn on the organic EL elements 4 in the pixel block and the values of currents are detected by the current detection circuit 170.

Figure 6B:
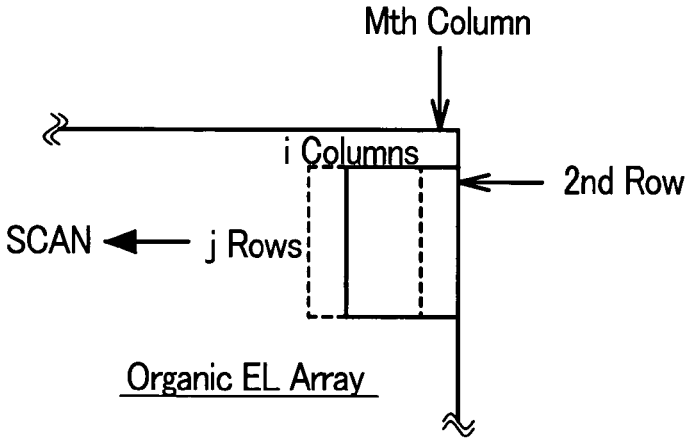
Figure 6C:
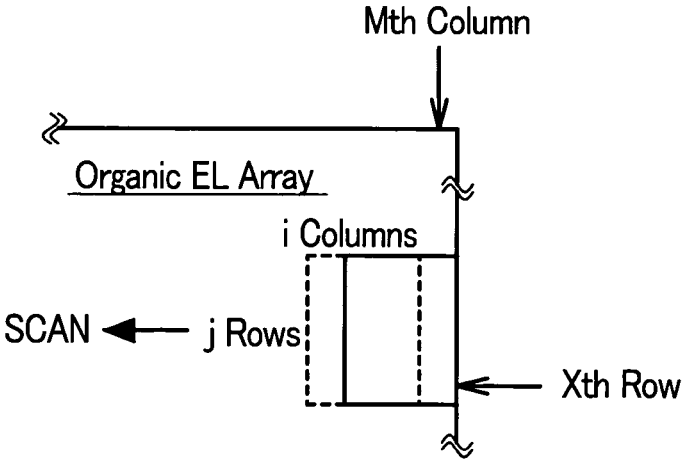

Next, the pixel block is scanned by shifting the pixel block along the extension direction of the column one pixel by one pixel from the first row to the (N−j) row so as to turn on the organic EL elements 4 in the pixel block and the values of currents are detected by the current detection circuit 170. This scanning sequence is exemplified as respective locations of solid-lined frames shifting from that in FIG. 6A to that in FIG. 6C (in the same direction as that of the first sequence).

With respect to each stage during the scanning in the column direction, the pixel block is scanned by shifting the pixel block one pixel by one pixel from the Mth column to the first column so as to turn on the organic EL elements 4 in the pixel block and the values of currents are detected by the current detection circuit 170. This scanning is started from each of the starting areas exemplified by the solid-lined frame shown in FIGS. 6A–6C. Accordingly, the values of currents of the regions which cannot be detected during the first sequence explained in FIGS. 4A–4C are detected.

<Fourth Sequence>

Figure 7A:
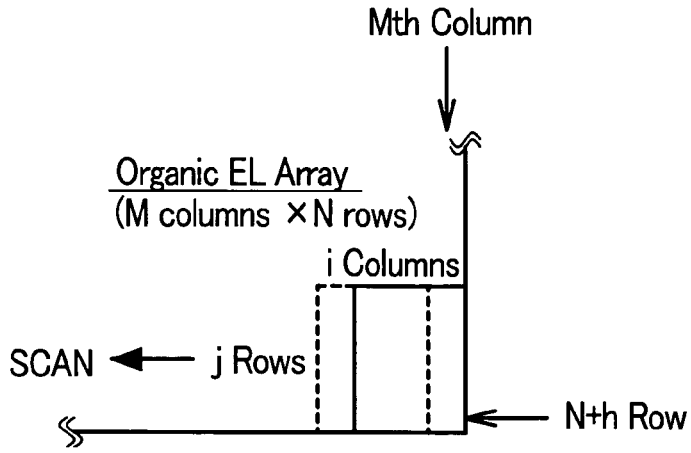
FIG. 7 is a view for explaining the method for detecting current values which flow in organic EL elements of respective pixels in the embodiment of the present invention.

Further, as shown in FIG. 7A, the driving voltage is applied to the driving TFT 3 of the respective pixels in the pixel block which is constituted of the pixels of i columns×j rows including pixels of the Nth row and the Mth column in the display part 100 so as to turn on the organic EL elements 4 in the pixel block and the values of currents are detected by the current detection circuit 170.

Figure 7B:
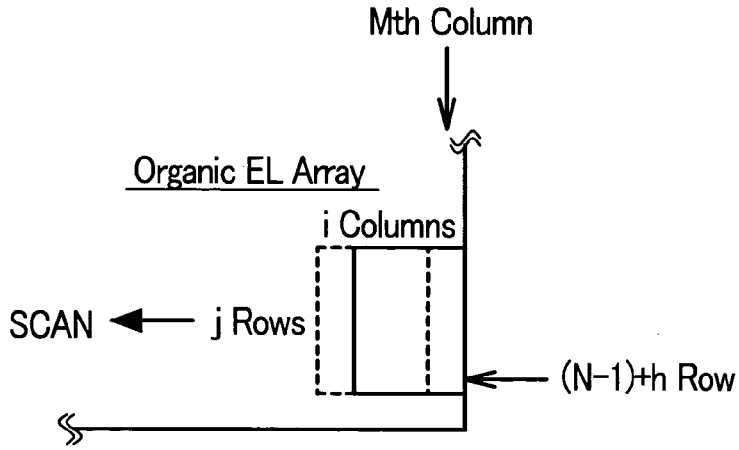
Figure 7C:
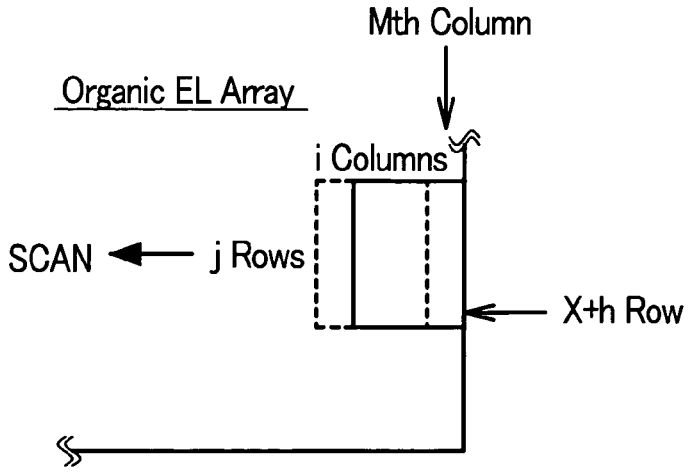

Next, the pixel block is scanned by shifting the pixel block along the extension direction of the column one pixel by one pixel from the Nth row to the first row so as to turn on the organic EL elements 4 in the pixel block and the values of currents are detected by the current detection circuit 170. This scanning sequence is exemplified as respective locations of solid-lined frames shifting from that in FIG. 7A to that in FIG. 7C (in the same direction as that of the second sequence).

With respect to the column direction, the pixel block is scanned by shifting the pixel block one pixel by one pixel from the Mth column to the first column so as to turn on the organic EL elements 4 in the pixel block and the values of currents are detected by the current detection circuit 170. This scanning is started from each of the starting areas exemplified by the solid-lined frame shown in FIGS. 7A–7C. Accordingly, the values of currents of the regions which cannot be detected during the first sequence explained in FIGS. 4A–4C are detected.

Figure 8:
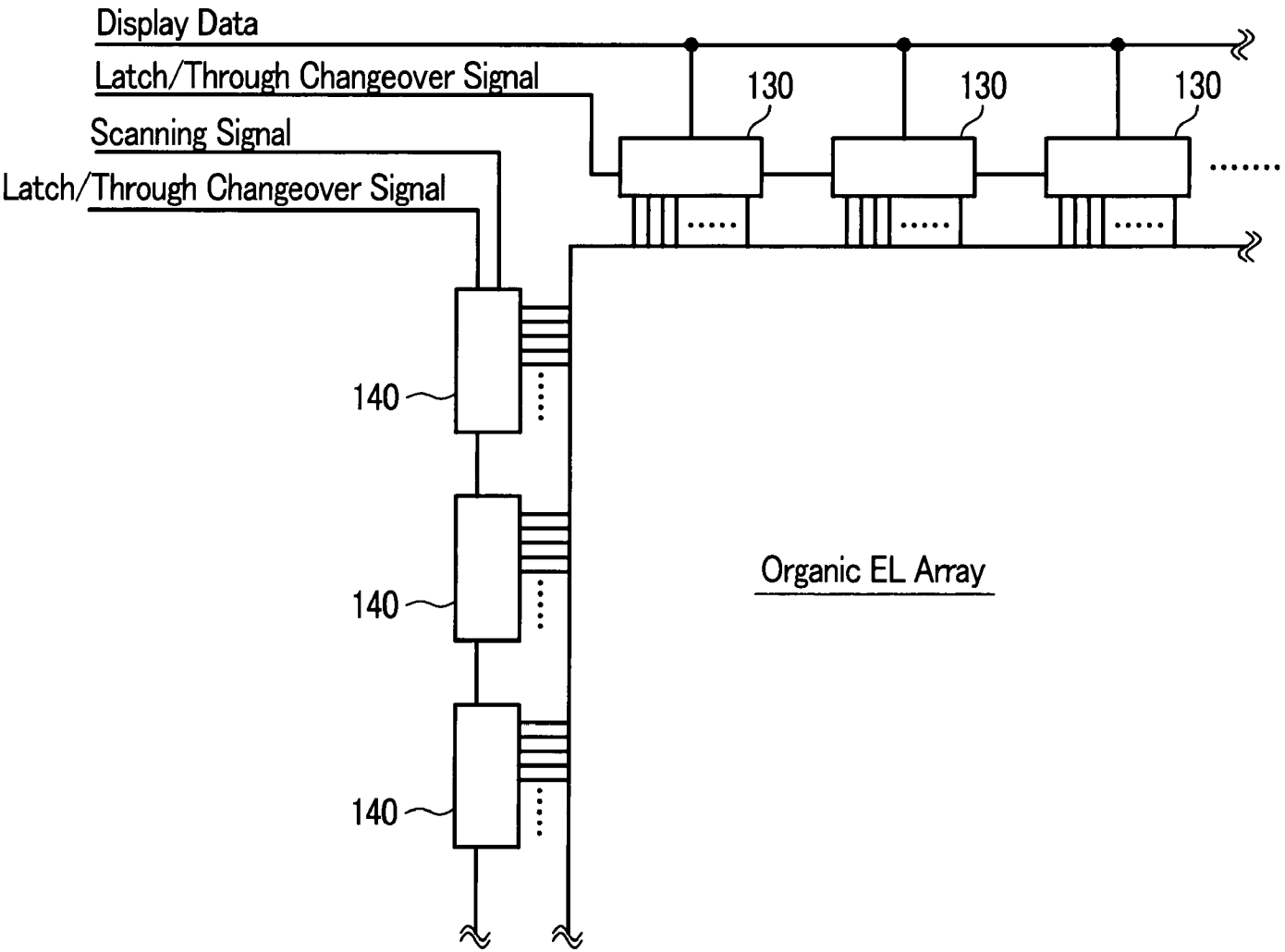
FIG. 8 is a view for explaining a data driver and a scanning driving circuit of the embodiment of the present invention.

FIG. 8 is a view for explaining the data driver 130 and the scanning driving circuit 140 of this embodiment for executing the above-mentioned processing.

In general, the data driver 130 includes a latch circuit for latching the display data, while the scanning driving circuit 140 includes a latch circuit for latching scanning signals.

In this embodiment, the latch circuit is replaced with a latch/through circuit and a latch/through changeover signal is transmitted to the data drivers 130 and the scanning driving circuits 140 from the timing control circuit 110 so as to designate the above-mentioned pixel block which is constituted of pixels of i columns×j rows.

In this embodiment, the above-mentioned processing is executed with respect to the driving voltages corresponding to all gray scale voltages and the correction data for every pixel of all pixels of the display part 100 and every gray scale of all gray scales of the display part 100 are stored in the frame memory 160.

Figure 9:
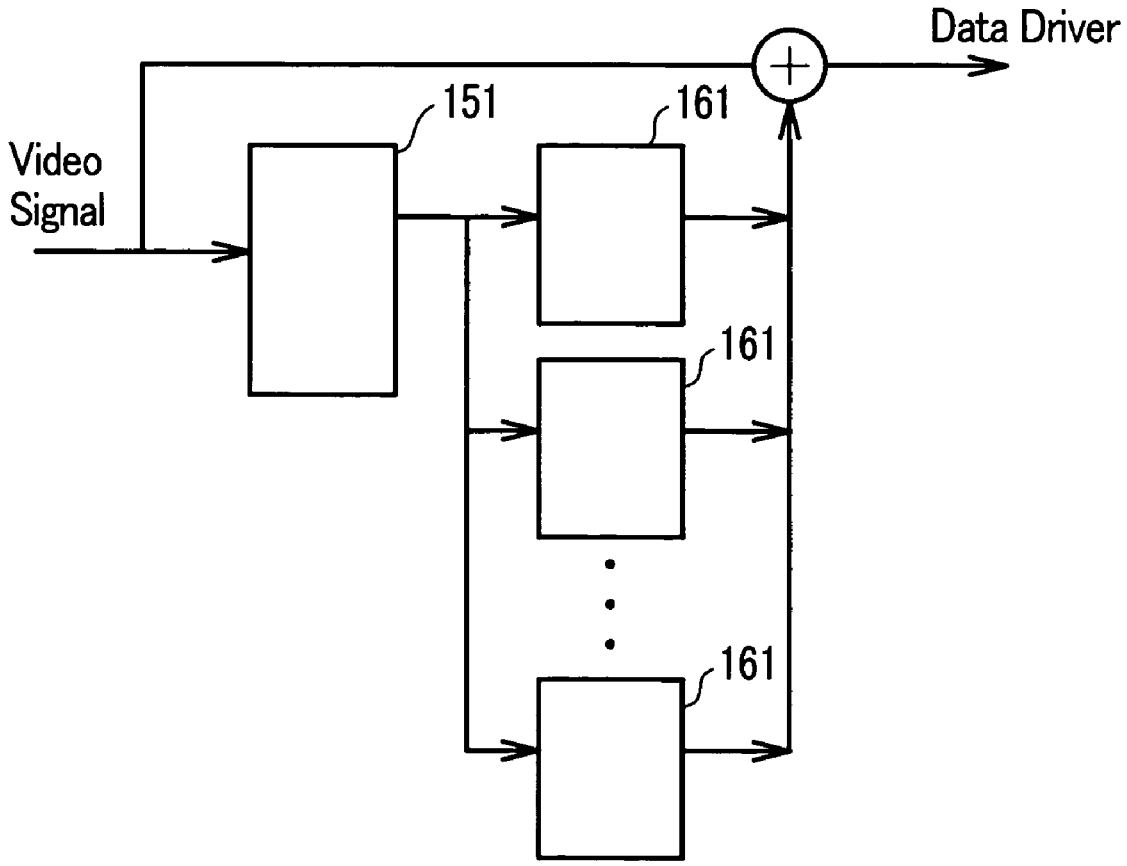
FIG. 9 is a view for explaining the processing steps at the time of reading correction data in this embodiment of the present invention.

Then, in reading out the correction data, as shown in FIG. 9, a frame memory control circuit 150 decodes video signal data inputted from the outside by a decoder 151, reads out the correction data from a correction data table 161 corresponding to gray scales which the video signal data indicate in the frame memory 160, and transmits the correction data to the data driver 130 in a form that the correction data is added to the video signal data inputted from the outside.

Figure 10:
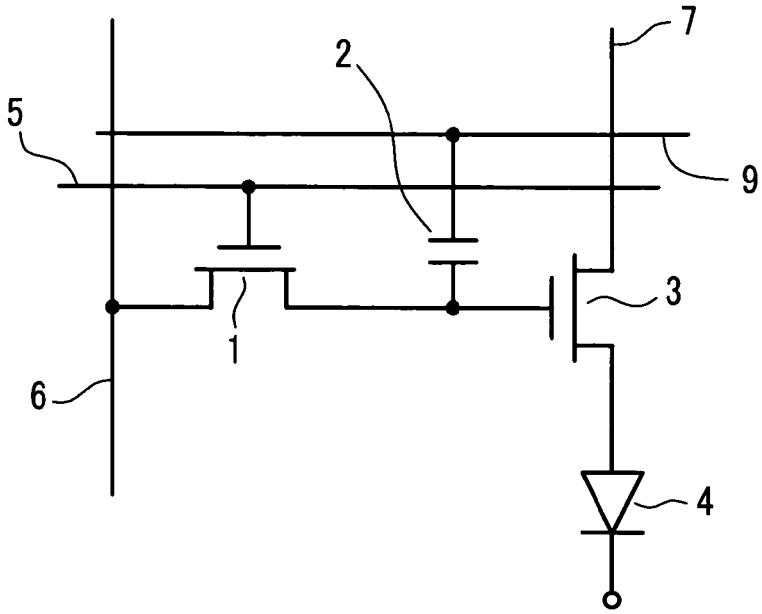
FIG. 10 is an equivalent circuit diagram showing another example of the constitution of one pixel of the display part shown in FIG. 2.

FIG. 10 is an equivalent circuit diagram showing another example of the constitution of one pixel of the display part 100 shown in FIG. 1. The pixel shown in FIG. 10 differs from the pixel shown in FIG. 2 with respect to a point that the data holding capacitive element 2 is connected between the gate of the driving TFT 3 and the storing capacitive line 9.

Figure 11:
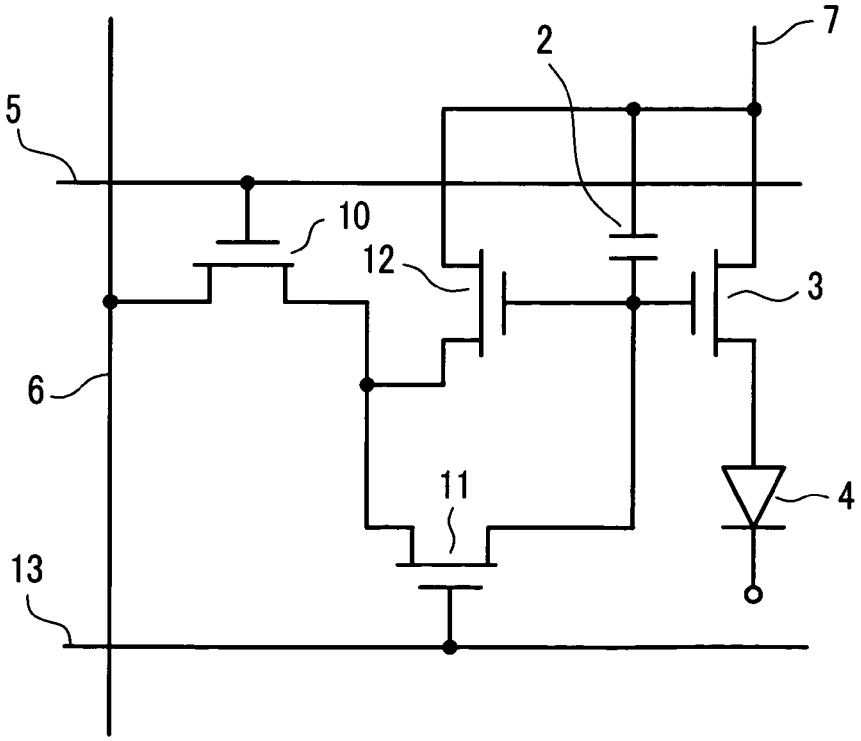
FIG. 11 is an equivalent circuit diagram showing another example of the constitution of one pixel of the display part shown in FIG. 2.

FIG. 11 is an equivalent circuit diagram showing another example of the constitution of one pixel of the display part 100 shown in FIG. 1.

The pixel shown in FIG. 11 differs from the pixel shown in FIG. 2 with respect to a point that the pixel uses four TFTs, wherein the pixel is provided with a first switching thin film transistor (a 1st switching TFT, hereinafter) 10, a second switching thin film transistor (a 2nd switching TFT, hereinafter) 11, a third switching thin film transistor (a 3rd switching TFT, hereinafter) 12 and a secondary scanning line 13.

Figure 12:
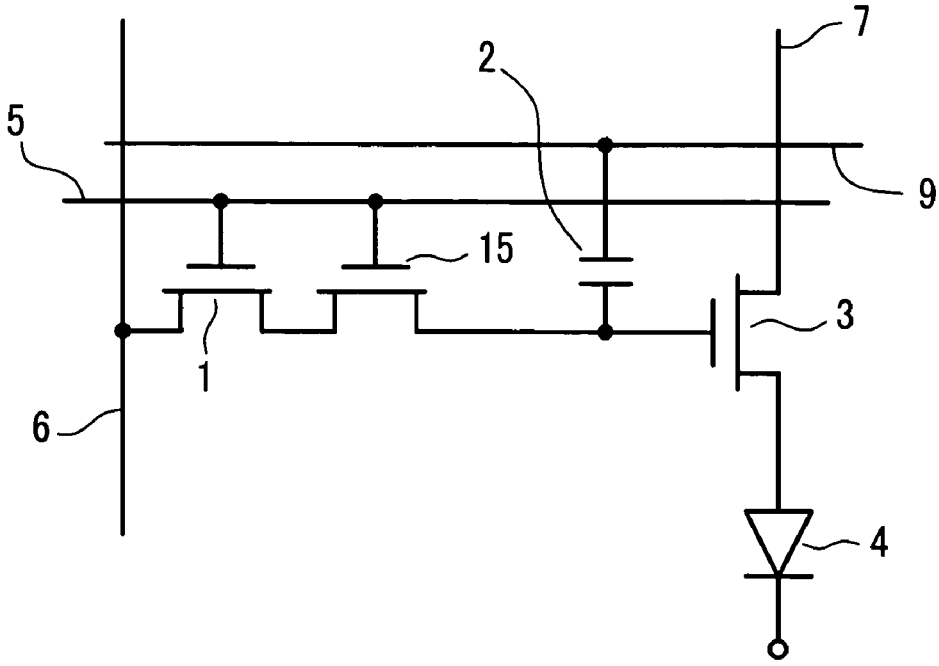
FIG. 12 is an equivalent circuit diagram showing another example of the constitution of one pixel of the display part shown in FIG. 2.

FIG. 12 is an equivalent circuit diagram showing another example of the constitution of one pixel of the display part 100 shown in FIG. 1.

The pixel shown in FIG. 12 differs from the pixel shown in FIG. 10 with respect to a point that two pieces of TFT, that is, the 1st switching TFT 1 and its auxiliary TFT 15 are used as the data writing TFT shown in FIG. 2.

Figure 13:
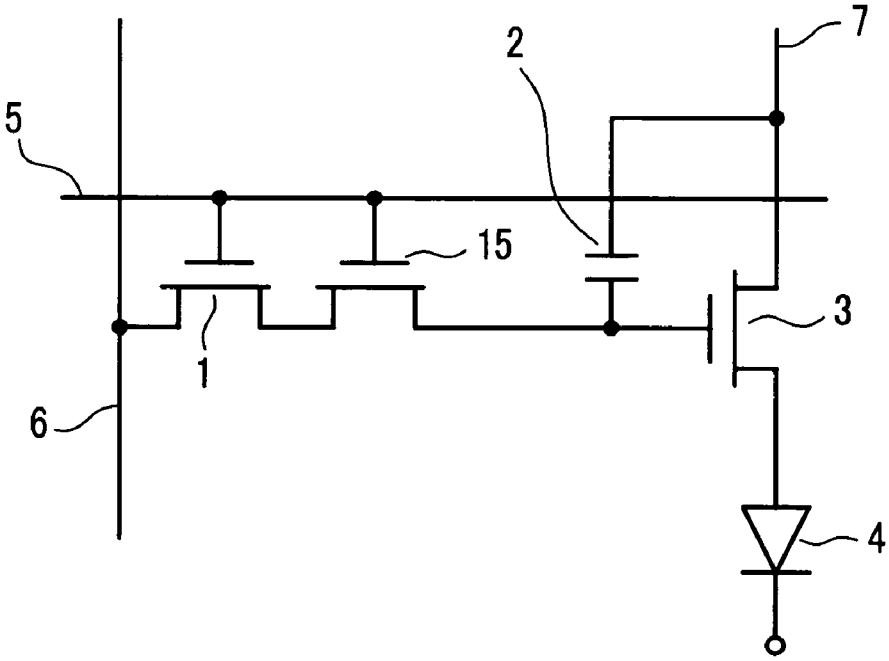
FIG. 13 is an equivalent circuit diagram showing another example of the constitution of one pixel of the display part shown in FIG. 2.

FIG. 13 is an equivalent circuit diagram showing another example of the constitution of one pixel of the display part 100 shown in FIG. 1.

The pixel shown in FIG. 13 differs from the pixel shown in FIG. 2 with respect to a point that two TFTs, that is, the 1st switching TFT 1 and its auxiliary TFT 15 are used as the data writing TFT shown in FIG. 2.

Here, any one of these pixel constitutions is the well known constitution and hence, the detailed explanation is omitted.

Here, in this embodiment, the above-mentioned processing shown in FIG. 4 to FIG. 7 is executed with respect to driving voltages corresponding to all gray scale voltages. Accordingly, when the resolution of the display part 100 is increased, the processing time is prolonged.

Hereinafter, a technique for shortening this processing time is explained.

With respect to the pixels at specified positions, current values when the driving voltages corresponding to all gray scale voltages are applied are obtained and the correction data are calculated with respect to the all gray scales.

With respect to other pixels, when the gray scales are 256, for example, the values of currents when the driving voltages corresponding to the gray scale voltages of every 32 gray scales are applied are obtained and, thereafter, the correction data are calculated.

Then, by taking into consideration that the I–V characteristics of the organic EL elements 4 are equal so long as the organic elements 4 are within the same panel, with respect to the intermediate gray scales of every 32 gray scales, the values of currents when the driving voltages corresponding to the all gray scales (here, 256 gray scales) voltages are applied are obtained and the correction data are calculated. By simply shifting the I–V characteristics of the pixels at the specified positions, the data of the I–V characteristics are interpolated.

Further, as described previously, in this embodiment, the correction data for every pixel of all pixels of the display part 100 and for every gray scale of all gray scales are stored in the frame memory 160. Accordingly, the memory capacitance of the frame memory 160 is increased.

Hereinafter, a technique for reducing the memory capacitance of the frame memory 160 is explained.

(1) The correction data are not stored with respect to all pixels on the screen. That is, the screen is divided into m×n [for example (m=16, n=16), (m=32, n=32), (m=64, n=64)] sections and the correction data with respect to m×n pixels is stored.

(2) All correction data are not stored for all gray scales. That is, the low gray scales which exhibit outstanding irregularities with respect to the threshold values are finely corrected while the high gray scales are roughly corrected. For example, 8 bits are corrected to 4 bits and 8 bits is constituted of bits of two pixels.

Further, the gray scales to be corrected are, when all gray scales are 256 gray scales, for example, set to values which can be divided by 7, 15, 23, 31, 39, 47, 55, 63 (every other 8 gray scales up to this value), 79, 95, 111, 127 (every other 16 gray scales up to this value), and 159, 191, 223, 255 (every other 32 gray scales up to this value) within 0 to 256 gray scales.

(3) At a stage that the EL display device is prepared, the image is displayed on the display part 100 and the above-mentioned correction data are calculated with respect to the pixels in the regions where the uniformity of brightness is apparent.

Further, in this embodiment, although the above-mentioned processing is assumed to be performed in a state that power is ON, when a display having a button such as a screen adjustment button or the like is provided, even when the screen adjustment button is pushed, the pixel block consisting of pixels of i columns and j rows may be scanned so as to update the correction data table 161 and to correct the screen.

As has been explained heretofore, according to the embodiment, in the active matrix type EL display device adopting the analogue driving method, the number of driving TFTs for driving the organic EL elements 4 can be reduced and hence, the uniformity of brightness is enhanced and, at the same time, the image quality of the display image can be enhanced.

Although the invention made by inventors of the present invention has been specifically explained based on the embodiment, it is needless to say that the present invention is not limited to the above-mentioned embodiment and various modifications can be made without departing from the gist of the present invention.

To briefly recapitulate advantageous effects obtained by typical inventions among inventions disclosed in the present application, they are as follows.

According to the present invention, in the display device adopting the analogue type driving method, it is possible to prevent the lowering of the brightness uniformity generated due to the irregularities of the threshold values of the driving transistors and hence, the uniformity of the brightness can be enhanced.

What is claimed is:

1. A method of driving a display device which includes a display part having pixels of M columns×N rows and a memory, wherein each pixel includes a light emitting element and a driving transistor for driving the light emitting element, the method comprising:

a step 1 of applying a driving voltage to the driving transistor of each pixel so as to turn on the light emitting element of each pixel and detecting a value of current which flows in the light emitting element of each pixel at times other than a usual light emitting time, a step 2 of calculating correction data for each pixel based on the value of current detected in the step 1;

a step 3 of storing the correction data of each pixel calculated in the step 2 in the memory, and a step 4 of applying a driving voltage based on data which is obtained by adding the calculated correction data stored in the memory to video signal data to the driving transistor of each pixel at the usual light emitting time, wherein the step 1, includes:

a step 11 in which a driving voltage is applied to the driving transistors of respective pixels in a pixel block formed of the pixels of i (i<M) columns×j(j<N) rows to turn on only the light emitting elements of respective pixels in the inside of the pixel block and detects the values of currents which flow in the respective light emitting elements in the inside of the pixel block by shifting the pixel block in the row direction and the column direction one pixel by one pixel, and a step of detecting a value of current of one pixel by obtaining a difference among the values of currents which flow in the respective light emitting elements in the inside of the pixel block detected in the step 11.

2. A method of driving a display device which includes a display part having pixels of M columns×N rows and a memory, wherein each pixel includes a light emitting element and a driving transistor for driving the light emitting element, the method comprising:

a step 1 of applying a driving voltage to the driving transistor of each pixel so as to turn on the light emitting element of each pixel and detecting a value of current which flows in the light emitting element of each pixel at times other than a usual light emitting time, a step 2 of calculating correction data for each pixel based on the value of current detected in the step 1;

a step 3 of storing the correction data of each pixel calculated in the step 2 in the memory, and a step 4 of applying a driving voltage based on data which is obtained by adding the calculated correction data stored in the memory to video signal data to the driving transistor of each pixel at the usual light emitting time, wherein in the step 1, driving voltages corresponding to all gray scales are applied to the driving transistors of the respective pixels, and the values of currents which flow in the light emitting elements of respective pixels are detected with respect to every gray scale of all gray scales, and in the step 2, correction data for every gray scale of all gray scales is calculated for every pixel.

3. A method for driving a display device which includes a display part having pixels of M columns×N rows and a memory, wherein each pixel includes a light emitting element and a driving transistor for driving the light emitting element, the method comprising:

a step 1 of applying a driving voltage to the driving transistor of each pixel so as to turn on the light emitting element of each pixel and detecting a value of current which flows in the light emitting element of each pixel at times other than a usual light emitting time, a step 2 of calculating correction data for each pixel based on the value of current detected in the step 1;

a step 3 of storing the correction data of each pixel calculated in the step 2 in the memory, and a step 4 of applying a driving voltage based on data which is obtained by adding the calculated correction data stored in the memory to video signal data to the driving transistor of each pixel at the usual light emitting time, wherein in the step 1, driving voltages corresponding to k gray scales in all gray scales are applied to the driving transistors of the respective pixels and the values of currents which flow in the light emitting elements of respective pixels are detected for every k gray scales, and in the step 2, correction data for every k gray scales are calculated for every pixel.

4. A method for driving a display device which includes a display part having pixels of M columns×N rows and a memory, wherein each pixel includes a light emitting element and a driving transistor for driving the light emitting element, the method comprising:

a step 1 of applying a driving voltage to the driving transistor of each pixel so as to turn on the light emitting element of each pixel and detecting a value of current which flows in the light emitting element of each pixel at times other than a usual light emitting time, a step 2 of calculating correction data for each pixel based on the value of current detected in the step 1;

a step 3 of storing the correction data of each pixel calculated in the step 2 in the memory, and a step 4 of applying a driving voltage based on data which is obtained by adding the calculated correction data stored in the memory to video signal data to the driving transistor of each pixel at the usual light emitting time, wherein in the step 1, driving voltages corresponding to all gray scales are applied to the driving transistors of the specified pixels and the values of currents which flow in the light emitting elements of the specified pixels are detected for every gray scale of all gray scales and, at the same time, driving voltages corresponding to the k gray scales in all gray scales are applied to the driving transistors of other pixels and the values of currents which flow in the light emitting elements of other pixels are detected for every k gray scales, and in the step 2, correction data for every gray scale of all gray scales are calculated based on the values of currents for every gray scale of all gray scales detected in the step 1 with respect to the specified pixels, and the correction data for every k gray scales are calculated based on the values of currents for every k gray scales detected in the step 1 with respect to other pixels and, at the same time, correction data of gray scales other than the k gray scales are calculated based on the collection data of the specified pixels.

* * * * *